US007177557B2

(12) United States Patent
Kreckel

(10) Patent No.: US 7,177,557 B2
(45) Date of Patent: Feb. 13, 2007

(54) METHOD FOR CALCULATING TONER AGE AND A METHOD FOR CALCULATING CARRIER AGE FOR USE IN PRINT ENGINE DIAGNOSTICS

(75) Inventor: Douglas A. Kreckel, Webster, NY (US)

(73) Assignee: Xerox Corporation, Stamford, CT (US)

( * ) Notice: Subject to any disclaimer, the term of this patent is extended or adjusted under 35 U.S.C. 154(b) by 97 days.

(21) Appl. No.: 10/834,650

(22) Filed: Apr. 29, 2004

(65) Prior Publication Data

US 2005/0244172 A1 Nov. 3, 2005

(51) Int. Cl.
*G03G 15/08* (2006.01)

(52) U.S. Cl. ..... 399/27; 399/30; 399/62; 399/257

(58) Field of Classification Search ..... 399/27–30, 399/58, 61, 62, 257
See application file for complete search history.

(56) References Cited

U.S. PATENT DOCUMENTS

| | | | | |
|---|---|---|---|---|
| 4,439,034 | A * | 3/1984 | Daniels | 399/257 |
| 5,025,289 | A * | 6/1991 | Guslits et al. | 399/257 |
| 6,047,142 | A | 4/2000 | Donaldson | 399/27 |
| 6,160,970 | A * | 12/2000 | Scheuer et al. | 399/58 |
| 6,374,064 | B1 * | 4/2002 | Budnik et al. | 399/27 |
| 6,505,832 | B2 | 1/2003 | Moore et al. | 271/265.01 |
| 2003/0235434 | A1 * | 12/2003 | Godlove | 399/257 |

* cited by examiner

*Primary Examiner*—Susan Lee
(74) *Attorney, Agent, or Firm*—Lloyd Bean, II

(57) ABSTRACT

The present invention generally relates to a digital imaging system or a light lens based imaging system. More specifically, the present invention provides an improved method and apparatus for calculating toner age and, additionally, carrier age using a toner concentration sensor and the amount of material dispensed. Both of these quantities can be used to ensure image quality by anticipating or diagnosing problems in image quality, which may be caused by toner age or carrier age.

19 Claims, 4 Drawing Sheets

METHOD FOR CALCULATING TONER AGE AND A METHOD FOR CALCULATING CARRIER AGE FOR USE IN PRINT ENGINE DIAGNOSTICS

FIELD OF THE INVENTION

The present invention generally relates to a copier or digital imaging system. More specifically, the present invention provides an improved method for calculating toner age and for calculating carrier age to ensure image quality by anticipating or diagnosing problems in image quality, which may be caused by toner age or carrier age. These problems include low developability, high background, light or incompletely developed solid areas, and halo defects appearing on sheets of support material.

BACKGROUND AND SUMMARY

Modern electronic copiers, printers, facsimile machines, etc. are capable of producing complex and interesting page images. The pages may include text, graphics, and scanned or computer-generated images. The image of a page may be described as a collection of simple image components or primitives (characters, lines, bitmaps, colors, etc.). Complex pages are built from these primitives using a page description language such as PostScript. The electronic printer's software converts these to an equivalent bit stream by a process called rasterization to build an internal, electronic model of the page. The data is contained in an image buffer in the form of an array of color values called pixels. A count of the number of pixels to be printed gives an estimate of the area of each page to be printed. The approach utilized for multicolor electrostatographic printing is substantially identical to the process described above. However, rather than forming a single latent image on the photoconductive surface in order to reproduce an original document, as in the case of black and white printing, multiple latent images corresponding to color separations are sequentially recorded on the photoconductive surface. Each single color electrostatic latent image is developed with toner of a color complimentary thereto and the process is repeated for differently colored images with the respective toner of complimentary color. Thereafter, each single color toner image can be transferred to the copy sheet in superimposed registration with the prior toner image, creating a multi-layered toner image on the copy sheet. Finally, this multi-layered toner image is permanently affixed to the copy sheet in substantially conventional manner to form a finished copy.

With the increase in use and flexibility of printing machines, especially color printing machines which print with two or more different colored toners, it has become increasingly important to monitor the toner development process so that increased print quality, stability and control requirements can be met and maintained. For example, it is very important for each component color of a multi-color image to be stably formed at the correct toner density because any deviation from the correct toner density may be visible in the final composite image. Additionally, deviations from desired toner densities may also cause visible defects in mono-color images, particularly when such images are half-tone images. Therefore, many methods have been developed to monitor the toner development process to detect present or prevent future image quality problems.

For example, it is known to monitor the developed mass per unit area (DMA) for a toner development process by using densitometers such as infrared densitometers (IRDs) to measure the mass of a toner process control patch formed on an imaging member. IRDs measure total developed mass (i.e., on the imaging member), which is a function of developability and electrostatics.

Electrostatic voltages are measured using a sensor such as an ElectroStatic Voltmeter (ESV). Developability is the rate at which development (toner mass/area) takes place. The rate is usually a function of the toner concentration in the developer housing. Toner concentration (TC) is measured by directly measuring the percentage of toner in the developer housing (which, as is well known, contains toner and carrier particles).

As indicated above, the development process is typically monitored (and thereby controlled) by measuring the mass of a toner process control patch and by measuring toner concentration (TC) in the developer housing. However, the relationship between TC and developability is affected by other variables such as ambient temperature, humidity and the age of the toner. For example, a three-percent TC results in different developabilities depending on the variables listed above. Therefore, in order to ensure good developability, which is necessary to provide high quality images, toner age must be considered.

The following disclosure may be relevant: U.S. Pat. No. 6,047,142 which hereby is incorporated by reference. That patent discloses that in order to ensure good developability, which is necessary to provide high quality images, toner age must be considered. In that patent a method for estimating toner age is described in which pixel count is used to estimate the amount of toner used to form a xerographic image.

Additionally, Applicants have found that it may be important to also monitor the age of the other component of the developer, the carrier. When carriers which are used in conductive or semiconductive magnetic brush development systems become encased in toner resin fines they may become too insulative to function properly, leading to poor development of solid areas. Alternatively, coatings on the carrier which are present to provide proper tribocharging of the toner, can wear off with the result that the carrier no longer functions as intended. The severity of either mode of degradation is proportional to how long the carrier has been in use, i.e. the carrier age. Monitoring the carrier age will allow one to take appropriate service actions based on the carrier age. Such actions may include, but are not necessarily limited to, adding extra raw carrier, to flush old material, using a special, high carrier content replenisher, or simply installing a new developer.

In some print engines and copiers, some carrier may be mixed with the toner which is added to replace that used in making prints or copies. (In general, this material, whether just toner or a mixture of toner and other components such as carrier will be called replenisher.) In these cases measurement of the carrier age must be made in a manner analogous to that used to measure toner age.

There is provided a method for estimating both toner age and carrier age based on measuring the amount of replenisher actually dispensed. This method is robust against errors which can arise from using pixel count as the basis for estimating the toner age or carrier age. In image-on-image development systems, the developed mass per unit area will depend on whether the developed toner is deposited directly on the photoreceptor or is deposited on toner developed in previous steps. Thus the average developed toner mass per unit area (dma) will depend on the image content, and thus be prone to error. These errors are compounded further by non-linear half toning effects. As an example, a 10% half-tone will require developing $1/10^{th}$ the available pixels in a given area, but the amount of toner developed under the same conditions used to develop the solid will, in general not be 10% of the amount required to develop all the pixels in that area. This departure from proportionality to the fraction of pixels developed will change with the proportion of pixels and may change with selected print conditions, such as darkness or lightness control settings. Additionally, the pixel count cannot account for non-printing toner usage such as emissions or while adding toner without developing (a tone-up process). A properly calibrated system for dispensing toner or replenisher material into a developer housing to replace the material removed provides an alternate and improved method for measuring toner age. In addition, it does not require the additional electronic circuitry associated with counting pixels. Because a pixel count is not used, the invention is also applicable to copiers and similar devices which do not have digital images.

There is provided a method for measuring and controlling developer age in a developer housing having developer including carrier and toner comprising: providing a maximum developer age in a memory; sensing toner concentration in the developer housing and storing toner concentration in the memory; calculating the amount of dispensed replenisher from the dispense rate and the toner in the replenisher; determining toner age, carrier age or the age of both components in the developer housing based upon the toner concentration, and the amount of replenisher dispensed since a previous age calculation; and interrupting a print job when the toner age is greater than a maximum toner age, when the carrier age is greater than a maximum carrier age, or when the component ages in combination is greater than some maximum value.

There is also provided an apparatus for measuring and controlling toner age in a developer housing comprising: a memory storing a maximum toner age, a maximum carrier age or both; a dispenser for dispensing replenisher to a developer housing at a dispense rate; determining toner age, carrier age or both in the developer housing based upon the toner concentration, and the amount of replenisher dispensed since a previous age calculation; and a toner concentration sensor sensing a toner concentration in the developer housing; a mass sensor sensing a developed mass per unit area; and a control unit receiving the dispense rate, the toner concentration and the developed mass per unit area, determining the toner age, the carrier age, or both ages in the developer housing based upon the dispense rate, and the toner concentration, and initiating a purging of the toner in the developer housing when the toner age is greater than the maximum toner age.

DETAILED DESCRIPTION

Figure 1:
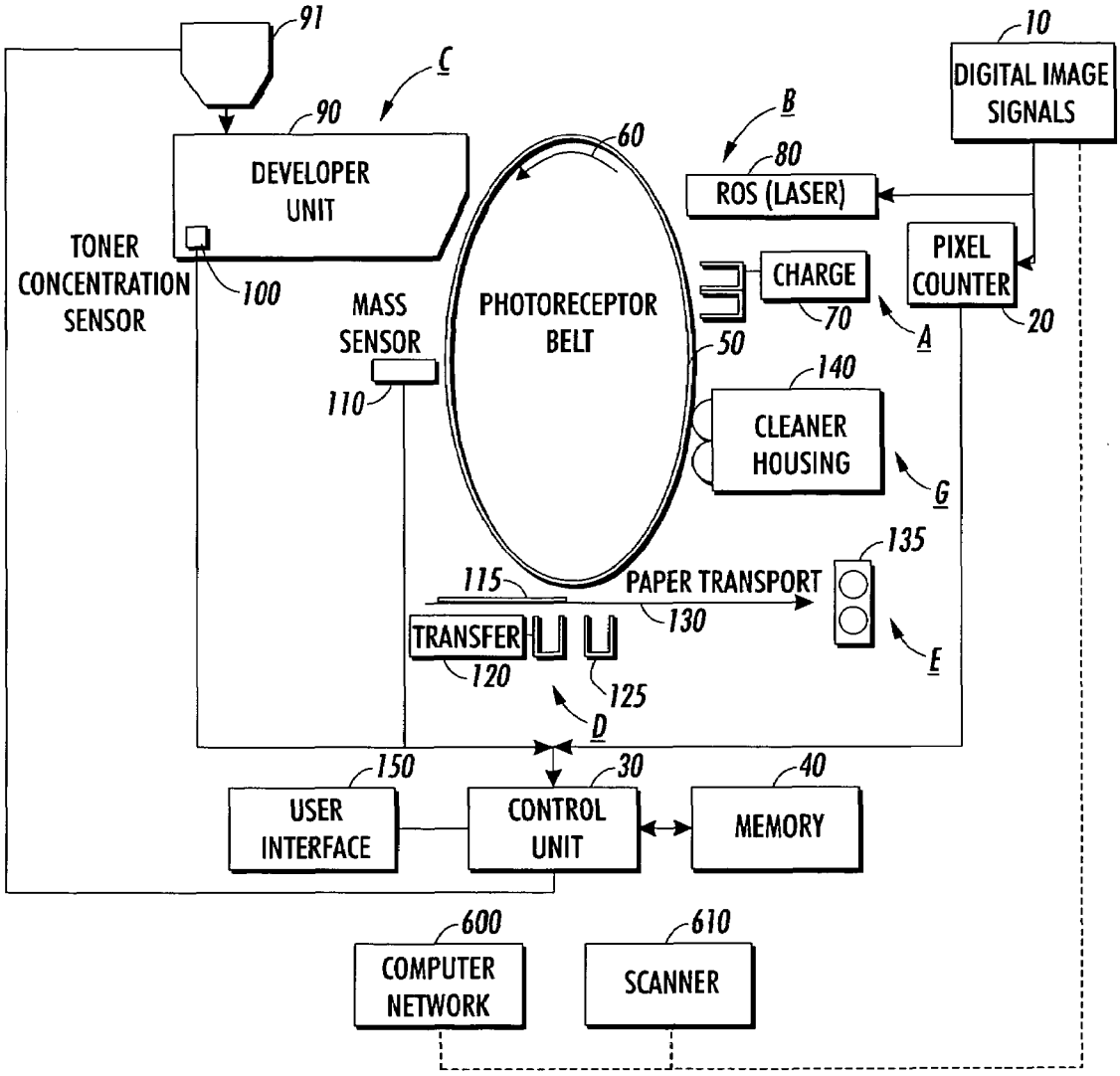
FIG. 1 is a partial schematic of an example of a print engine for a digital imaging system, which can employ the toner age and/or carrier age calculation of the present invention.

FIG. 1 shows a partial schematic of an example of a print engine for a digital imaging system. Digital image signals 10 from a computer network 600, scanner 610, or other digital image signal generating device are received by a pixel counter 20, which counts the number of pixels in the digital image. The digital image signals 10 represent the desired output image to be imparted on at least one sheet or in one non-printing area. The pixel counter 20 outputs this information to a control unit 30, which stores this information in memory 40. The control unit 30 may be a microprocessor or other control device. The pixel counter 20 may be incorporated into the control unit 30.

A photoreceptor belt 50 advances sequentially through various xerographic process stations in the direction indicated by arrow 60. Other types of photoreceptors such as a photoreceptor drum may be substituted for the photoreceptor belt 50 for sequentially advancing through the xerographic process stations. A portion of the photoreceptor belt 50 passes through charging station A, where a charging unit 70 charges the photoconductive surface of photoreceptor belt 60 to a substantially uniform potential. Preferably, charging unit 70 is a corona-generating device such as a dicorotron.

Subsequently, the charged portion of photoreceptor belt 50 is advanced through imaging/exposure station B. The control unit 30 receives the digital image signals 10 from at least one digital image signal generating such as a scanning device (not shown). The control unit 30 processes and transmits these digital image signals 10 to an exposure device, which is preferably a raster output scanner 80 located at imaging/exposure station B. However, other xerographic exposure devices such as a plurality of light emitting diodes (an LED bar) could be used in place of the raster output scanner 80. The raster output scanner (ROS) 80 causes the charge retentive surface of the photoconductive belt 50 to be discharged at certain locations on the photoconductive belt 50 in accordance with the digital image signals 10 output from the digital image generating device. Thus, a latent image is formed on photoconductive belt 50.

Next, the photoconductive belt 50 advances the latent image to a development station C, where toner is electrostatically attracted to the latent image using commonly known techniques. The latent image attracts toner particles from the carrier granules in a developer unit 90 forming a toner powder image thereon. Alternatively, the developer unit 90 may utilize a hybrid development system, in which the development roll, better known as the donor roll, is powered by two development fields (potentials across the air gap). The first field is the ac field which is used for toner cloud generation. The second field is the dc development field which is used to control the amount of developed toner mass on the photoreceptor belt 50. Appropriate developer biasing is accomplished by way of a power supply. This type of system is a noncontact type in which only toner particles are attracted to a latent image and there is no mechanical contact between the photoreceptor belt 50 and the toner delivery device. However, the present invention can be utilized in a contact system as well. In accordance with the present invention, the developer unit 90 includes a toner concentration sensor 100, such as a packer toner concentration sensor or an optical toner concentration sensor, for sensing toner concentration (TC). A mass sensor 110, such as an enhanced toner area coverage (ETAC) sensor, measures developed mass per unit area.

Subsequent to image development, a sheet of support material 115 is moved into contact with toner images at transfer station D. The sheet of support material 115 is advanced to transfer station D by any known sheet feeding apparatus (not shown). The sheet of support material 115 is then brought into contact with the photoconductive surface of photoconductive belt 50 in a timed sequence so that the toner powder image developed thereon contacts the advancing sheet of support material 115 at transfer station D. Transfer station D preferably includes a transfer unit 120. Transfer unit 120 includes a corona-generating device, which is preferably a dicorotron. The corona-generating device sprays ions onto the backside of sheet of support material 115. This attracts the oppositely charged toner particle images from the photoreceptor belt 50 onto the sheet of support material 115. A detack unit 125 (preferably a detack dicorotron) is provided for facilitating stripping of the sheet of support material 115 from the photoreceptor belt 50.

After transfer, the sheet of support material 115 continues to advance toward fuser station E on a conveyor belt (not shown) in the direction of arrow 130. Fuser station E includes a fuser unit 135, which includes fuser and pressure rollers to permanently affix the image to the sheet of support material 115. After fusing, a chute, not shown, guides the advancing sheets of support material 115 to a catch tray, stacker, finisher or other output device (not shown), for subsequent removal from the print engine by the operator.

After the sheet of support material 115 is separated from photoconductive surface of photoreceptor belt 50, the residual toner particles carried by the non-image areas on the photoconductive surface are removed therefrom. These particles are removed at cleaning station G, using, for example, a cleaning brush or plural brush structure contained in a cleaner housing 140. However, the cleaning station G may utilize any number of well known cleaning systems.

Control unit 30 regulates the various print engine functions. The control unit 30 is preferably a programmable controller (such as a microprocessor), which controls the print engine functions hereinbefore described. The control unit 30 may provide a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by an operator. Moreover, the control unit 30 reads or receives information from sensors such as toner concentration sensor 100 and mass sensor 110 for calculating toner age in order to predict or diagnose degradation in image quality. Based on this calculation, an appropriate action may be taken to restore image quality or prevent degradation in image quality before it occurs.

The control unit 30 also calculates the amount of replenisher to be dispensed to compensate for toner used in making the image. That value is transmitted to dispense unit 91; a replenisher dispensing unit which dispenses replenisher at a known rate; (One such method is to set a dispense duty cycle to an appropriate value between 0 and 100% with the controller, then use the known maximum dispense rate multiplied by that duty cycle to calculate the dispense rate.); a memory unit for storing the 100% duty cycle dispense rate, the duty cycle being used, the time at which the duty cycle was set or the interval over which it is in use, the toner age and toner age limits, the carrier age and carrier age limits, the proportion of carrier in the replenisher and such other information as is needed in the following calculations; and the means for calculating new toner ages, new carrier ages, dispense rates, and if necessary the interval from the saved and current time stamp.

Figure 2:
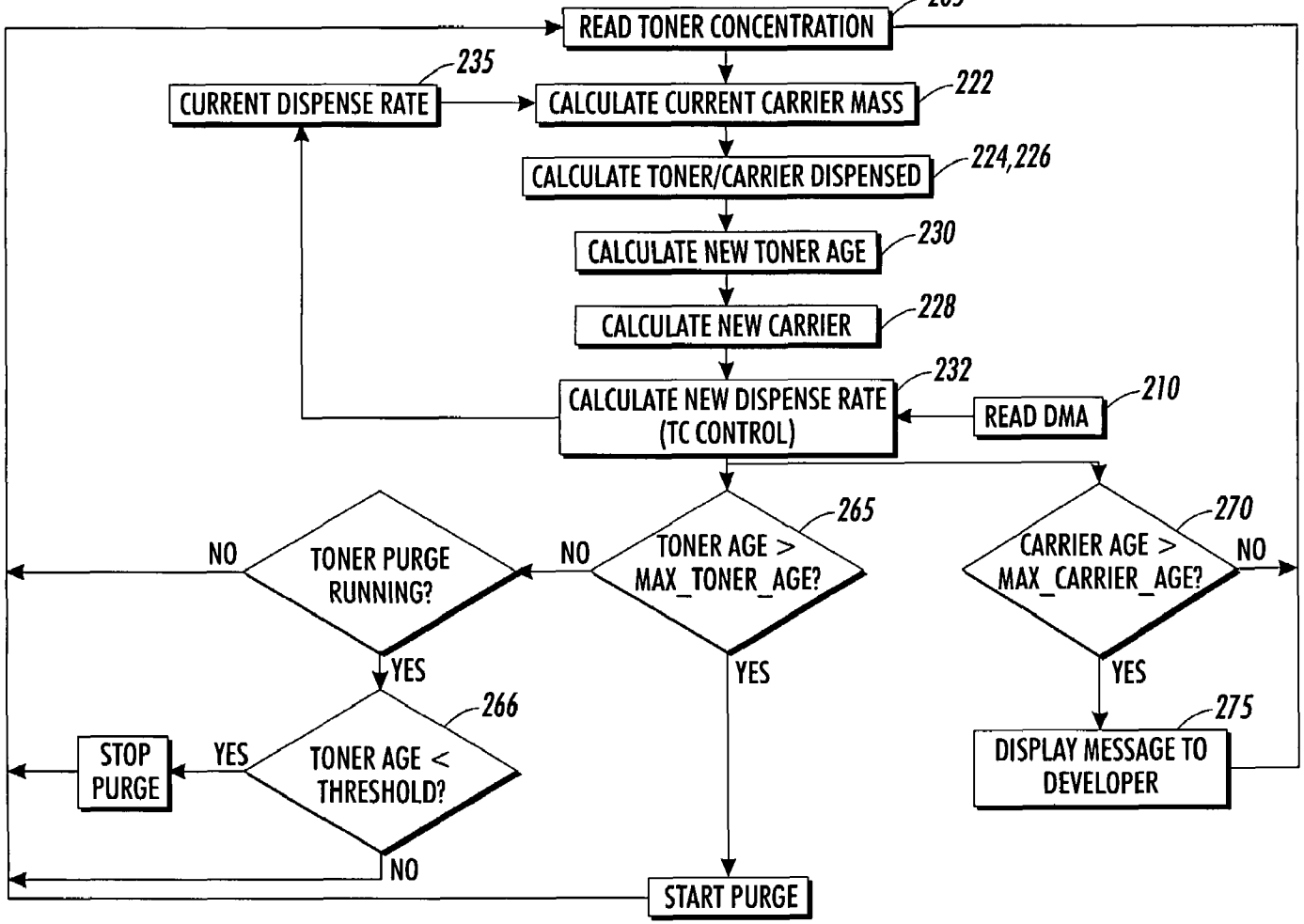
FIG. 2 is a flow chart showing the carrier age calculation in accordance with the present invention.

FIG. 2 is a flow chart showing the process of the present invention, which calculates toner age and carrier age, and takes appropriate action based upon the results of the toner age or carrier age calculations. Preferably, the control unit 30 reads the toner concentration (TC) every n seconds, wherein n is a positive number, and this number is stored in memory 40 (step 205). The control unit 30 reads the developed mass per unit area (DMA), sensed by mass sensor 110, and stores the DMA in memory 40 (step 210). The dispense rate used since the last update (step 235) is retrieved from memory and the following values are calculated: the current carrier mass (step 222), the amount of toner added since the last update (step 224), the amount of carrier added via the replenisher (step 226), the new carrier age (step 228) and the new toner age (step 230). The TC and the dma, with other available information, which may include pixel counts, is used by the toner concentration control algorithm (step 232, not described here) calculates the amount of toner which is to be added to the developer housing in order to replace the amount used since the previous update, and stores that value in memory 40 (step 235) for use in the next update of toner and carrier ages. The proportion of toner in the replenisher and the dispense rate which the dispense unit 91 is capable of maintaining are also maintained in memory 40.

An embodiment of the invention requires some modification and extension of the toner age calculations as disclosed in U.S. Pat. No. 6,047,142. Mathematically, the algorithm provided in that reference gives $$\text{Age}(i)=(\text{Age}(i-1)+\text{Interval})*(\text{TotalMass}-\text{MassOut})/\text{TotalMass} \quad \text{(eq a)}$$

where Age(i−1) refers to the toner age at the previous time the age was calculated, Age(i) refers to the toner age at the present time and Interval is the elapsed time between time(i−1) and time(i) and where $$\text{TotalMass}=\text{TCSensed}*\text{CarrierMass} \quad \text{(eq b)}$$

and CarrierMass is typically a constant mass which is governed by the developer system design, as defined in the reference.

In the present embodiment, for toner age, we use $$\text{Age}(i)=(\text{Age}(i-1)+\text{Interval})*(\text{TotalMass}/(\text{Total/Mass}+\text{MassIn}(i)) \quad \text{(eq c)}$$

where TotalMass is as defined above, $$\text{MassIn}(i)=\text{DutyCycle}(i)*\text{DispenseRate}*\text{Interval}*(\text{TonerToCarrierRatio}/(1+\text{TonerToCarrierRatio})) \quad \text{(eq d)}$$

and DutyCycle(i) is the dispense demand as calculated in the TC control algorithm and implemented in the dispense control algorithm for time interval from time(i−1) to time(i). DispenseRate is the mass dispense rate at 100% duty cycle and TonerToCarrierRatio is the mass ratio of toner to carrier in the replenisher. (If no carrier is included, the term TonerToCarrierRatio/(1+TonerToCarrierRatio)=1). If the dispensed toner has an effective age different from zero, the equation can be modified to read $$\text{Age}(i)=(\text{Age}(i-1)+\text{Interval})*(\text{TotalMass}/(\text{TotalMass}+\text{MassIn}(i))+\text{Age}(0)*(\text{MassIn}(i)/(\text{TotalMass}+\text{MassIn}(i)) \quad \text{(eq e)}$$

and Age(0) is the effective age of the added toner.

An equivalent form for the above calculation, suitable for more lengthy intervals or cases in which Interval is not constant is $$\mathrm{Age}(t)=\mathrm{Age}(t_0)+\tau*(1-\exp(-(t-t_0)/\tau)) \quad \text{(eq f)}$$

And $$\tau=\mathrm{TotalMass}/(\mathrm{MassIn}(t)*(t-t_0)) \quad \text{(eq g)}$$

and calculates the new toner age, Age(t), after dispensing MassIn(t) over the interval from $t_0$ to t.

The above equation is modified to give carrier age estimates according to $$\mathrm{CarrierAge}(i)=(\mathrm{CarrierAge}(i-1)+\mathrm{Interval})*(\mathrm{CarrierMass}/(\mathrm{CarrierMass}+\mathrm{CarrierMassIn})) \quad \text{(eq h)}$$

where CarrierMass is as defined above, and $$\mathrm{CarrierMassIn}=\mathrm{DutyCycle}*\mathrm{DispenseRate}*(1/(1+\mathrm{TonerToCarrierRatio})) \quad \text{(eq i)}$$

Correspondingly, the carrier age may also be calculated at irregular intervals, using equations comparable to equations f & g, above:

$$\mathrm{CarrierAge}(t)=\mathrm{CarrierAge}(t_0)+\tau_c*(1-\exp(-(t-t_0)/\tau_c)) \quad \text{(eq j)}$$

And $$\tau_c=\mathrm{TotalMass}/(\mathrm{CarrierMassIn}(t)*(t-t_0)) \quad \text{(eq k)}$$

In each case the total usage can be found by simply accumulating and scaling the dispense DutyCycle value from the TC or dispense control algorithms:

$$\mathrm{ReplenisherUsed}(i)=\mathrm{ReplenisherUsed}(i-1)+\mathrm{DutyCycle}(i)*\mathrm{DispenseRate}*\mathrm{Interval} \quad \text{(eq l)}$$

$$\mathrm{TonerUsed}(i)=\mathrm{ReplenisherUsed}(i)*(\mathrm{TonerToCarrierRatio}/(1+\mathrm{TonerToCarrierRatio})) \quad \text{(eq m)}$$

$$\mathrm{CarrierUsed}(i)=\mathrm{ReplenisherUsed}(i)*(1/(1+\mathrm{TonerToCarrierRatio})) \quad \text{(eq n)}$$

After the new toner age and new carrier age are calculated, either or both the following two comparisons may be made. The comparison may be made in any order, though we show the toner age comparison being made first. The new toner age is compared to a predetermined maximum toner age, which is based on the appearance of image defects (step 245). An image is considered defective when the quality of the image does not meet predetermined customer, user or manufacturer print quality standards. If the current toner age is less than the predetermined age no action is taken and the process continues to the next step. If the current toner age is greater than the maximum toner age, a variety of actions may be dictated by the control program. The program could, for instance initiate the printing of Minimum Toner Area coverage (MAC) patches, in areas of the photoreceptor which are not used for the customers image. If the MAC patches are already being printed, the control program could also initiate a toner purge. These actions could be done sequentially based on different toner age thresholds. This might be necessary if the MAC patch is unable to forestall further aging. In the following we describe the case of the toner purge, though the above and more elaborate mitigation schemes could be used (step 265). The toner age continues to be recalculated during the toner purge routine, as in run-time, except that during the purge routine an out-of-range toner age does not trigger a fault or shut down the print engine. The toner purge routine decreases the toner age, for example, by running a high area coverage image. When the toner age falls below some lower threshold toner age (step 266), which may be the same as the maximum toner age or may be a different value, the toner purge is halted and the print engine reinitiates the interrupted job.

The predetermined toner age limits used in the comparisons described above are based on a variety of factors, including cost to customer, productivity and image quality. They may be modifiable by the control program itself according to other rules or base on other information available to the control system.

The usage of the carrier age, as calculated above, is illustrated in FIG. 2. It is somewhat analogous to the usage of the toner age. However, it differs in that high carrier age is associated with failure modes which are different from those associated with high toner age. The actions to be taken will differ accordingly. In step 270 the carrier age is compared to a maximum carrier age, which has been stored in memory 40. If the carrier age is above that threshold, the appropriate action is taken. One such action would be to inform a service representative that a replacement developer material needed to be installed, which could be accomplished during the current service call (step 275). Such action could then be taken before the copier or printer machine user noticed any substantial degradation in image quality, thereby avoiding extra service calls. Another such action might be to alter one or more of the maximum toner age values mentioned above. Alternatively, the service representative could determine that an alternative replenisher type, say one containing substantially more carrier material could be substituted for the replenisher being used. Another approach might be to simply add a quantity of fresh carrier to the developer housing to replace a portion of the degraded material.

Figure 3:
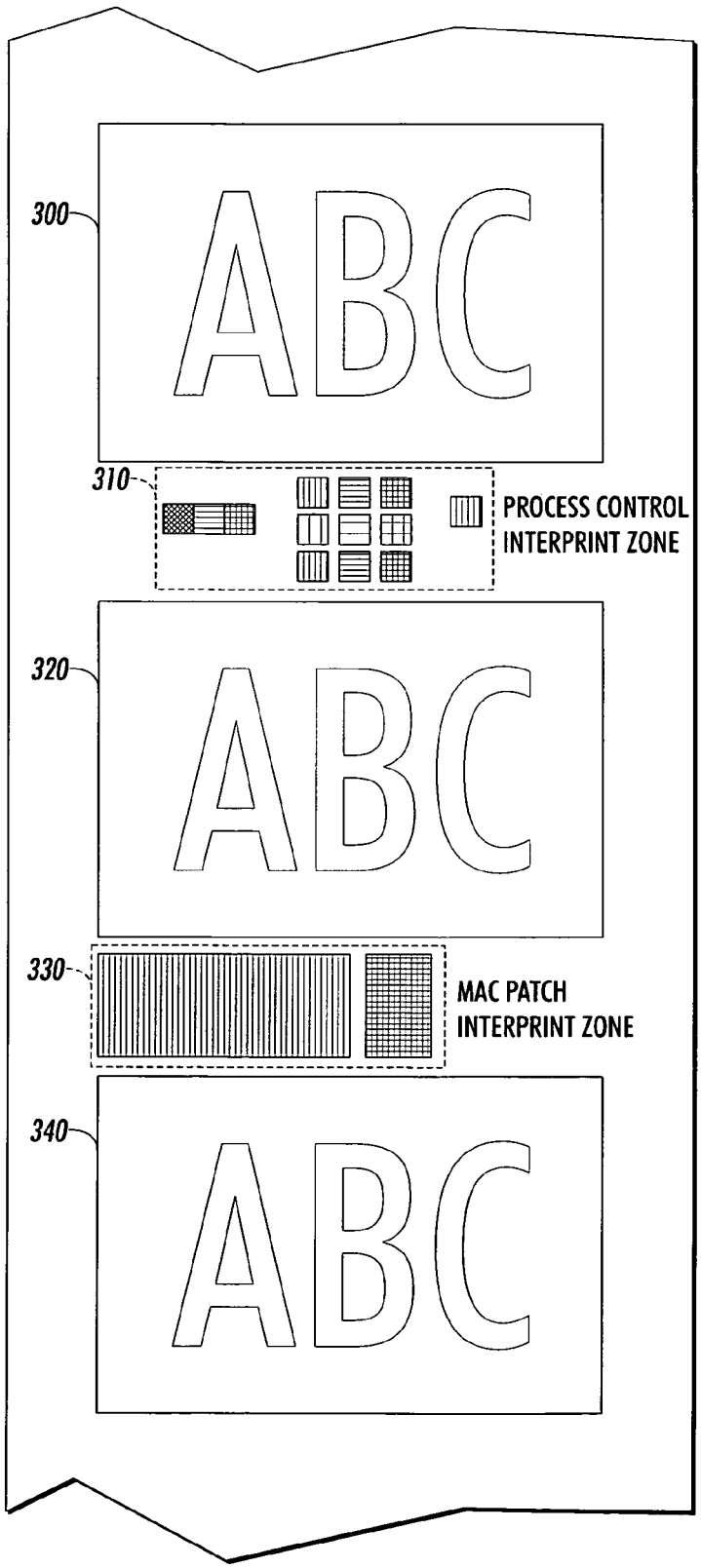
FIG. 3 shows one example of a layout of customer images, process control patches and MAC patches on a photoconductive surface.

FIG. 3 shows one example of a layout of customer images, process control patches and MAC patches on a photoconductive surface (e.g. surface of photoreceptive belt 50) over time. A print zone on the surface dedicated to the customer image 300 is followed by an interprint zone 310 in which control patches are laid out to be read by electrostatic or development sensors.

Another customer image 320 is laid out, followed by an interprint zone 330 in which one or more MAC patches are laid out, for the purpose of maintaining toner age. In FIG. 3, the MAC patch interprint zone 330 contains patches for two different colors. The MAC patch interprint zone is followed by another customer image 340. It is understood that FIG. 3 is just one example of the many different types of layouts that can be utilized. The MAC patches may consist of single layers of dry ink, or they may consist of two or more layers deposited on top of each other.

Figure 4:
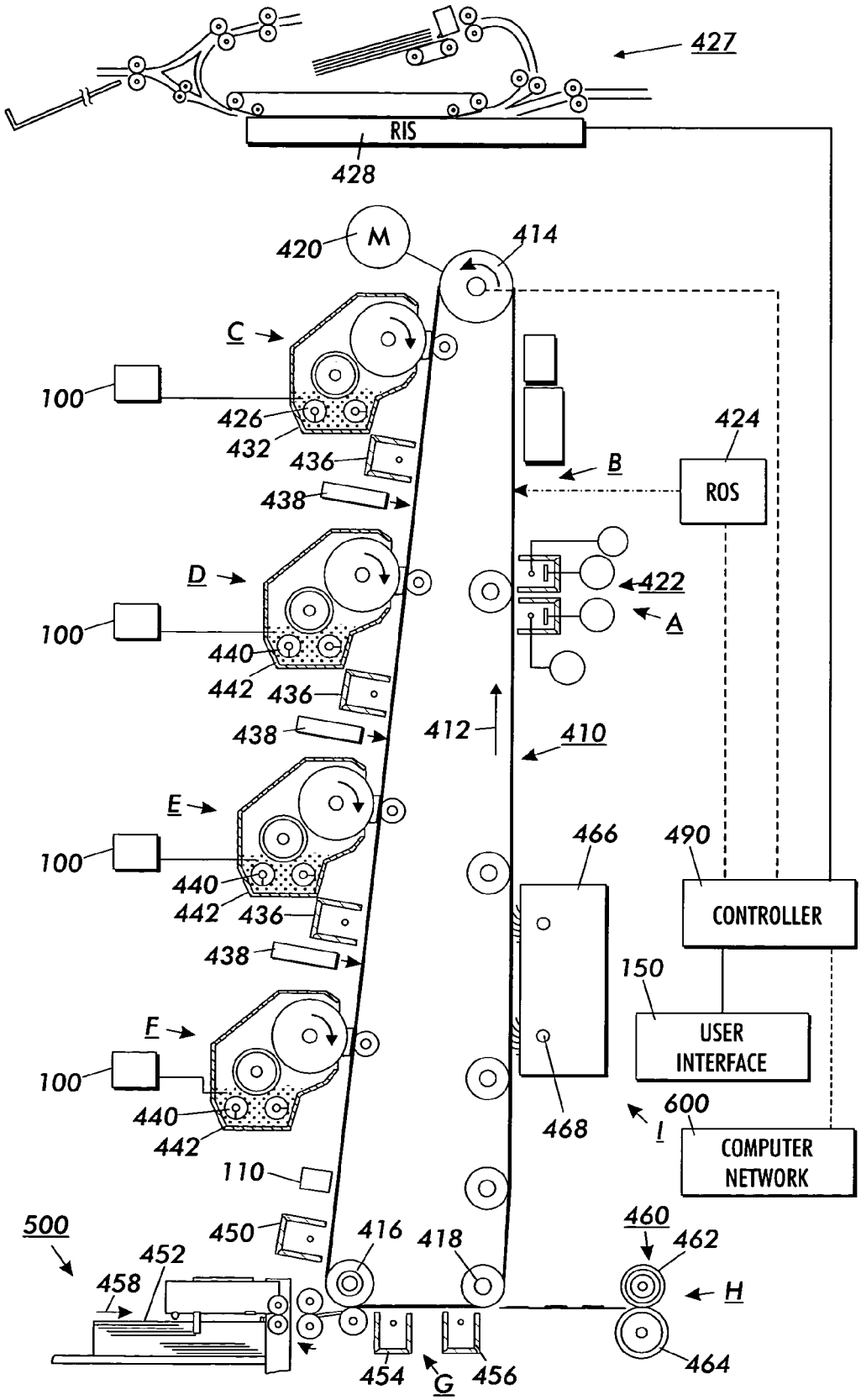
FIG. 4 is a partial schematic elevational view of another example of a digital imaging system, which can employ either the toner age calculation of the present invention, the carrier age calculation of the present invention, or both.

FIG. 4 is a partial schematic view of a digital imaging system, such as the digital imaging system of U.S. Pat. No. 6,505,832, utilizing the toner age calculation process and apparatus of the present invention. The imaging system is used to produce color output in a single pass of a photoreceptor belt. It will be understood, however, that it is not intended to limit the invention to the embodiment disclosed. On the contrary, it is intended to cover all alternatives, modifications and equivalents as may be included within the spirit and scope of the invention as defined by the appended claims, including a multiple pass color process system, a single or multiple pass highlight color system and a black and white printing system.

In this embodiment, an original document can be positioned in a document handler 427 on a raster-input scanner (RIS) indicated generally by reference numeral 428. The RIS 428 captures the entire original document and converts it to a series of raster scan lines or image signals. This information is transmitted to an electronic subsystem (ESS) or controller 490 which controls a raster output scanner (ROS) 424. In this embodiment, controller 490 includes a pixel counter. Alternatively, image signals may be supplied by a computer network 600.

The printing machine preferably uses a charge retentive surface in the form of an Active Matrix (AMAT) photoreceptor belt 410 supported for movement in the direction indicated by arrow 412, for advancing sequentially through the various xerographic process stations. The belt is entrained about a drive roller 414, tension rollers 416 and fixed roller 418 and the drive roller 414 is operatively connected to a drive motor 420 for effecting movement of the belt through the xerographic stations. A portion of belt 410 passes through charging station A where a corona generating device, indicated generally by the reference numeral 422, charges the photoconductive surface of photoreceptor belt 410 to a relatively high, substantially uniform, preferably negative potential.

Next, the charged portion of photoconductive surface is advanced through an imaging/exposure station B. At imaging/exposure station B, a controller, indicated generally by reference numeral 490, receives the image signals from raster input scanner 428 representing the desired output image and processes these signals to convert them to the various color separations of the image which is transmitted to a laser based output scanning device, which causes the charge retentive surface to be discharged in accordance with the output from the scanning device. Preferably the scanning device is a laser Raster Output Scanner (ROS) 424. Alternatively, the ROS 424 could be replaced by other xerographic exposure devices such as LED arrays.

The photoreceptor belt 410, which is initially charged to a voltage Vo, undergoes dark decay to a level equal to about −500 volts. When exposed at the exposure station B, it is discharged to a level equal to about −50 volts. Thus after exposure, the photoreceptor belt 410 contains a monopolar voltage profile of high and low voltages, the former corresponding to charged areas and the latter corresponding to discharged or background areas.

At a first development station C, developer structure, indicated generally by the reference numeral 432 utilizing a hybrid development system, the development roll, better known as the donor roll, is powered by two development fields (potentials across an air gap). The first field is the ac field which is used for toner cloud generation. The second field is the dc development field which is used to control the amount of developed toner mass on the photoreceptor belt 410. The toner cloud causes charged toner particles 426 to be attracted to the electrostatic latent image. Appropriate developer biasing is accomplished via a power supply. This type of system is a noncontact type in which only toner particles (black, for example) are attracted to the latent image and there is no mechanical contact between the photoreceptor belt 410 and a toner delivery device to disturb a previously developed, but unfixed, image. A toner concentration sensor 100 senses the toner concentration in the developer structure 432.

The developed but unfixed image is then transported past a second charging device 436 where the photoreceptor belt 410 and previously developed toner image areas are recharged to a predetermined level.

A second exposure/imaging is performed by device 438 which comprises a laser based output structure is utilized for selectively discharging the photoreceptor belt 410 on toned areas and/or bare areas, pursuant to the image to be developed with the second color toner. At this point, the photoreceptor belt 410 contains toned and untoned areas at relatively high voltage levels and toned and untoned areas at relatively low voltage levels. These low voltage areas represent image areas which are developed using discharged area development (DAD). To this end, a negatively charged, developer material 440 comprising color toner is employed. The toner, which by way of example may be yellow, is contained in a developer housing structure 442 disposed at a second developer station D and is presented to the latent images on the photoreceptor belt 410 by way of a second developer system. A power supply (not shown) serves to electrically bias the developer structure to a level effective to develop the discharged image areas with negatively charged yellow toner particles 440.

Further, a toner concentration sensor 100 senses the toner concentration in the developer structure 442. The above procedure is repeated for a third image for a third suitable color toner such as magenta (station E) and for a fourth image and suitable color toner such as cyan (station F). The exposure control scheme described below may be utilized for these subsequent imaging steps. In this manner a full color composite toner image is developed on the photoreceptor belt 410. In addition, a mass sensor 110 measures developed mass per unit area. Although only one mass sensor 110 is shown in FIG. 4, there may be more than one mass sensor 110.

To the extent to which some toner charge is totally neutralized, or the polarity reversed, thereby causing the composite image developed on the photoreceptor belt 410 to consist of both positive and negative toner, a negative pre-transfer dicorotron member 450 is provided to condition the toner for effective transfer to a substrate using positive corona discharge.

Subsequent to image development a sheet of support material 452 is moved into contact with the toner images at transfer station G. The sheet of support material 452 is advanced to transfer station G by a sheet feeding apparatus 500, described in detail below. The sheet of support material 452 is then brought into contact with photoconductive surface of photoreceptor belt 410 in a timed sequence so that the toner powder image developed thereon contacts the advancing sheet of support material 452 at transfer station G.

Transfer station G includes a transfer dicorotron 454 which sprays positive ions onto the backside of sheet 452. This attracts the negatively charged toner powder images from the photoreceptor belt 410 to sheet 452. A detack dicorotron 456 is provided for facilitating stripping of the sheets from the photoreceptor belt 410. After transfer, the sheet of support material 452 continues to move, in the direction of arrow 458, onto a conveyor (not shown) which advances the sheet to fusing station H. Fusing station H includes a fuser assembly, indicated generally by the reference numeral 460, which permanently affixes the transferred powder image to sheet 452. Preferably, fuser assembly 460 comprises a heated fuser roller 462 and a backup or pressure roller 464. Sheet 452 passes between fuser roller 462 and backup roller 464 with the toner powder image contacting fuser roller 462. In this manner, the toner powder images are permanently affixed to sheet 452.

After fusing, a chute, not shown, guides the advancing sheets 452 to a catch tray, stacker, finisher or other output device (not shown), for subsequent removal from the printing machine by the operator. After the sheet of support material 452 is separated from photoconductive surface of photoreceptor belt 410, the residual toner particles carried by the nonimage areas on the photoconductive surface are removed therefrom.

These particles are removed at cleaning station I using a cleaning brush or plural brush structure contained in a housing 466. The cleaning brush 468 or brushes 468 are engaged after the composite toner image is transferred to a sheet. Once the photoreceptor belt 410 is cleaned the brushes 468 are retracted utilizing a device incorporating a clutch (not shown) so that the next imaging and development cycle can begin.

Controller 490 regulates the various printer functions. The controller 490 is preferably a programmable controller, which controls printer functions hereinbefore described. The controller 490 may provide a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by an operator. Conventional sheet path sensors or switches may be utilized to keep track of the position of the document and the copy sheets.

The steps in the flow chart in FIG. 2 are repeated for each developer in FIG. 4 to measure the toner age. After the new toner age is calculated, the new toner age is compared to a predetermined maximum toner age, which is based on a variety of factors including cost to customer, productivity and image quality. (step 245).

If the current toner age is greater than the maximum toner age, then the control unit 30 recognizes a toner age fault and interrupts the current job (250).

The print engine enters a toner purge routine, and an appropriate message is displayed at a user interface 150 (step 260). When the toner purge routine is running, the toner age continues to be recalculated during the toner purge routine, as in run-time, except that during the purge routine an out-of-range toner age does not trigger a fault or shut down the print engine. The toner purge routine decreases the toner age, for example, by running a high area coverage image. At the end of the toner purge routine, the control program reinitiates the interrupted job.

If the new toner age is less than the predetermined maximum toner age, then the new toner age is compared to a predetermined toner age range (step 270). If the new toner age is less than the predetermined minimum toner age in 25 the toner age range, the quality of the images is not affected by toner age (step 275). The toner age calculation process is repeated at the next scheduled toner concentration read by returning to step 205. The predetermined minimum toner age is based on a variety of factors including cost to customer, productivity and image quality.

If the new toner age falls within the toner age range, then a MAC patch area is calculated based on the current toner age (step 280). The preferred MAC patch calculation minimizes toner usage and maximizes print engine productivity, while ensuring that toner age is maintained within the safe range, avoiding the necessity for toner purging and job interruption. The MAC patch area may be calculated automatically based on toner age in a number of different ways such as utilizing a look-up table. An interprint zone with appropriate MAC patch(es) is scheduled (step 285).

While the invention has been described in detail with reference to specific and preferred embodiments, it will be appreciated that various modifications and variations will be apparent to the artisan. All such modifications and embodiments as may occur to one skilled in the art are intended to be within the scope of the appended claims.

What is claimed is:

1. A method for measuring and controlling toner age in a developer housing having developer including carrier and toner comprising:

providing a maximum toner age in a memory;

sensing toner concentration in the developer housing and storing toner concentration in the memory;

calculating the amount of dispensed developer from the dispense rate and the toner in the replenisher;

determining toner age in the developer housing based upon the toner concentration, and the amount of developer dispensed since a previous developer age calculation; and interrupting a print job when the toner age is greater than a maximum toner age.

2. The method of claim 1, wherein calculating includes calculating toner age by applying the following equation:

$$\text{Age}(i)=(\text{Age}(i-1)+\text{Interval})*(\text{TotalMass}/(\text{TotalMass}+\text{MassIn}(i)))$$

where TotalMass is defined as initial developer mass in the developer housing where Age(i−1) refers to the toner age at the previous time the age was calculated, Age(i) refers to the toner age at the present time and Interval is the elapsed time between time(i−1) and time(i) and where MassIn(i) refers to the mass added to the developer housing at the present time.

3. The method of claim 1, wherein calculating includes determining carrier age by applying the following equation:

$$\text{CarrierAge}(i)=(\text{CarrierAge}(i-1)+\text{Interval})*(\text{CarrierMass}/(\text{CarrierMass}+\text{CarrierMassIn}))$$

where CarrierMass is as defined initial carrier in developer housing where carrier Age(i−1) refers to the carrier age at the previous time the age was calculated, carrier Age(i) refers to the carrier age at the present time and interval is the elapsed time between time(i−1) and time(i) and where CarrierMassIn(i) refers to the carrier mass added to the developer housing at the present time.

4. The method of claim 1, further comprising displaying on a user interface a message indicating the toner is being purged.

5. The method of claim 4, further comprising purging the toner in the developer housing to reduce the toner age in the developer housing.

6. The method of claim 5, further comprising calculating a minimum area coverage patch area to write toner when the toner age is in the toner age range in order to reduce the toner age in the developer housing.

7. The method of claim 6, further comprising scheduling an interprint zone with the minimum area coverage patch area in order to reduce the toner age in the developer housing.

8. An apparatus for measuring and controlling toner age in a developer housing comprising:

a memory storing a maximum toner age;

a dispenser for dispensing developer to a developer housing at a dispense rate;

means for determining toner age in said developer housing based upon a toner concentration, and the amount of replenisher dispensed since a previous toner age calculation;

means for determining carrier age in the developer housing based upon the toner concentration, and the amount of replenisher dispensed since a previous carrier age calculation; and a toner concentration sensor sensing a toner concentration in the developer housing;

a mass sensor sensing a developed mass per unit area; and a control unit for receiving the dispense rate, the toner concentration and the developed mass per unit area, determining the toner age in the developer housing based upon the dispense rate, and the toner concentration, and initiating a purging of the toner in the developer housing when the toner age is greater than the maximum toner age.

9. The apparatus of claim 8, further comprising a user interface displaying a message indicating the toner in the developer housing should be purged.

10. The apparatus of claim 8, wherein the memory stores a toner age range; and the control unit initiates writing toner to a minimum area coverage patch area to reduce said toner age when the toner age is in a predefined toner age range.

11. The method of claim 8, wherein calculating includes calculating toner age by applying the following equation:

$$\mathrm{Age}(t)=\mathrm{Age}(t_0)+\tau*(1-\exp(-(t-t_0)\tau))$$

And $$\tau=\mathrm{TotalMass}/(\mathrm{MassIn}(t)*(t-t_0))$$

where Age(t) refers to the toner age and TotalMass is as defined developer mass in the developer housing; MassIn(i) refers to the mass added to the developer housing at the present time.

12. The method of claim 8, wherein calculating includes calculating carrier age by applying the following equation:

$$\mathrm{CarrierAge}(t)=\mathrm{Age}(t_0)+\tau_c*(1-\exp(-(t-t_0)/\tau_c))$$

And $$\tau=\mathrm{TotalMass}/\mathrm{CarrierMassIn}(t)*(t-t_0))$$

where carrier Age(t) refers to the carrier age and TotalMass is as defined initial developer mass in the developer housing; MassIn(i) refers to the carrier mass added to the developer housing at the present time.

13. An electrostatic printing machine having a method for measuring and controlling toner age in a developer housing having developer including carrier and toner, the method comprising:

providing a maximum toner age in a memory;

providing a maximum carrier age in a memory;

sensing toner concentration in the developer housing and storing toner concentration in the memory;

calculating an amount of dispensed toner from a dispense rate and the toner in a replenisher;

calculating an amount of dispensed carrier from the dispense rate and the toner in the replenisher;

determining carrier age in the developer housing based upon the toner concentration, and the amount of replenisher dispensed since a previous carrier age calculation; and interrupting a print job when the carrier age is greater than a maximum toner age.

14. The method of claim 13, wherein calculating includes calculating toner age by applying the following equation:

$$\mathrm{Age}(i)=(\mathrm{Age}(i-1)+\mathrm{Interval})*(\mathrm{TotalMass}/(\mathrm{TotalMass}+\mathrm{MassIn}(i)))$$

where TotalMass is defined as initial developer mass in the developer housing where Age(i−1) refers to the toner age at the previous time the age was calculated, Age(i) refers to the toner age at the present time and Interval is the elapsed time between time(i−1) and time(i) and where MassIn(i) refers to the mass added to the developer housing at the present time.

15. The method of claim 13, wherein calculating includes determining carrier age by applying the following equation:

$$\mathrm{CarrierAge}(i)=(\mathrm{CarrierAge}(i-1)+\mathrm{Interval})*(\mathrm{CarrierMass}/(\mathrm{CarrierMass}+\mathrm{CarrierMassIn}))$$

where CarrierMass is as defined initial carrier in developer housing;

where carrier Age(i−1) refers to the carrier age at the previous time the age was calculated, carrier Age(i) refers to the carrier age at the present time and Interval is the elapsed time between time(i−1) and time(i) and where CarrierMassIn(i) refers to the carrier mass added to the developer housing at the present.

16. The method of claim 13, further comprising displaying on a user interface a message indicating the toner is being purged.

17. The method of claim 16, further comprising purging the toner in the developer housing to reduce the toner age in the developer housing.

18. The method of claim 17, further comprising calculating a minimum area coverage patch area to write toner when the toner age is in the toner age range in order to reduce the toner age in the developer housing.

19. The method of claim 18, further comprising the step of scheduling an interprint zone with the minimum area coverage patch area in order to reduce the toner age in the developer housing.

* * * * *